US005915785A

United States Patent [19]

Walker

[11] Patent Number: 5,915,785

[45] Date of Patent: Jun. 29, 1999

[54] JOIST SAFETY SKID

[76] Inventor: Nathaniel Walker, Rte. 2 Box 140 K-A, Bamberg, S.C. 29003

[21] Appl. No.: 08/903,605

[22] Filed: Jul. 31, 1997

[51] Int. Cl.[6] ..... E04G 1/36; A47C 4/00

[52] U.S. Cl. ..... 297/217.7; 297/250.1; 297/440.22; 182/178.3

[58] Field of Search ..... 297/250.1, 440.1, 297/440.14, 440.24, 440.22, 452.18, 452.2, 183.6, 217.7, 252; 182/178.3; 52/27

[56] References Cited

U.S. PATENT DOCUMENTS

| | | | |
|---|---|---|---|
| 900,247 | 10/1908 | Williams | 297/440.22 |
| 1,422,654 | 7/1922 | Bilger et al. | 182/178.3 X |
| 2,400,155 | 5/1946 | Letschert et al. | 297/183.6 X |
| 2,944,589 | 7/1960 | Balfour | 297/440.22 X |
| 4,086,980 | 5/1978 | Shortes et al. | 182/178.3 X |
| 4,121,690 | 10/1978 | Rawlings et al. . | |
| 4,497,093 | 2/1985 | Haberkorn . | |
| 4,520,515 | 6/1985 | Hatala | 297/440.22 X |
| 4,552,247 | 11/1985 | Purdy | 182/178.3 X |
| 4,586,844 | 5/1986 | Hammonds et al. | 182/178.3 X |
| 5,080,193 | 1/1992 | Woof | 182/178.3 X |

FOREIGN PATENT DOCUMENTS

| | | | |
|---|---|---|---|
| 2800002 | 7/1978 | Germany | 297/452.2 |

*Primary Examiner*—Peter M. Cuomo
*Assistant Examiner*—Hanh V. Tran

[57] ABSTRACT

A joist safety skid is provided including a plurality of components each having an H-shaped configuration. The components are adapted to be releasably coupled end-to-end. Further included is a seat removably coupled to at least one of the H-shaped components.

2 Claims, 2 Drawing Sheets

FIG. 1
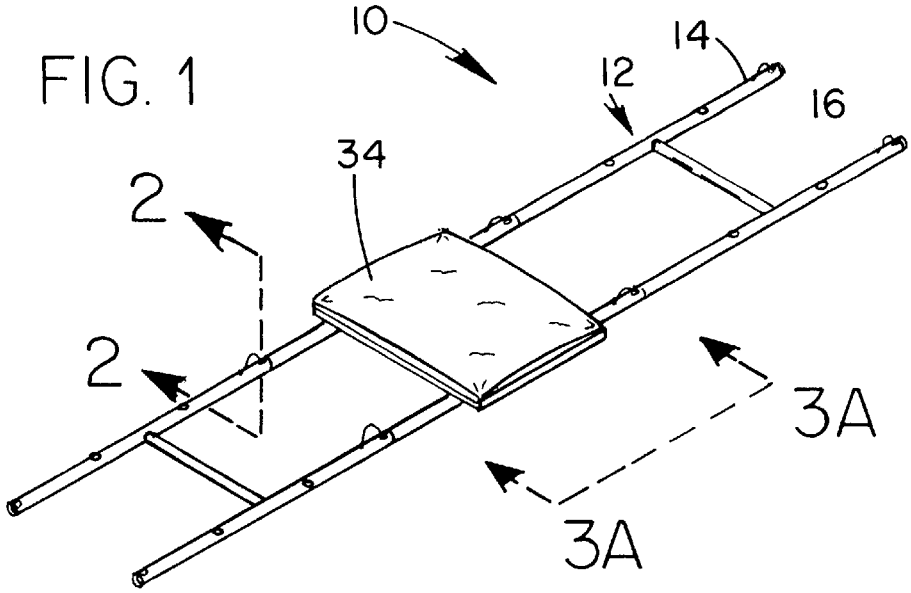
FIG. 2
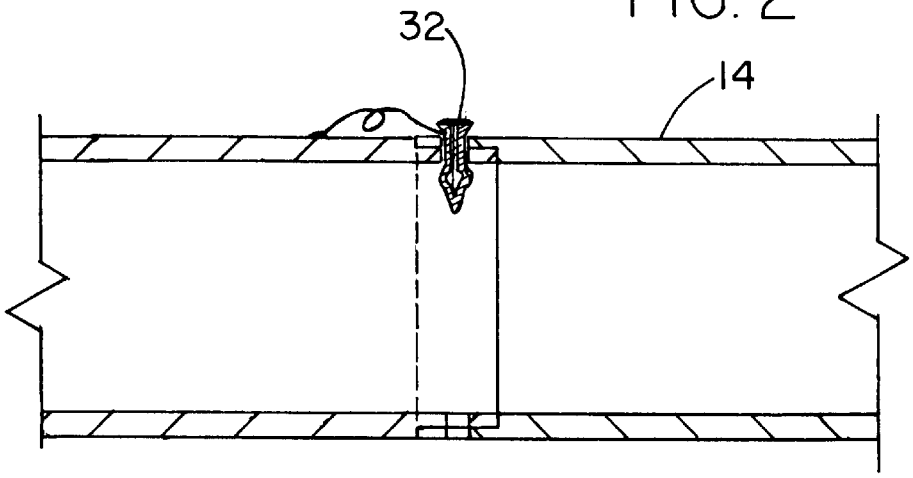
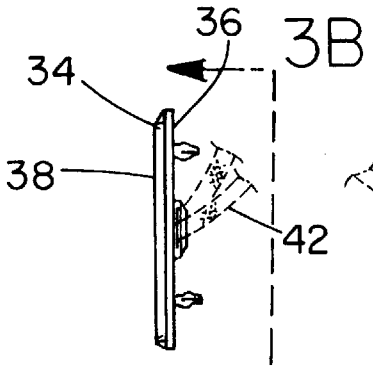
FIG. 3A
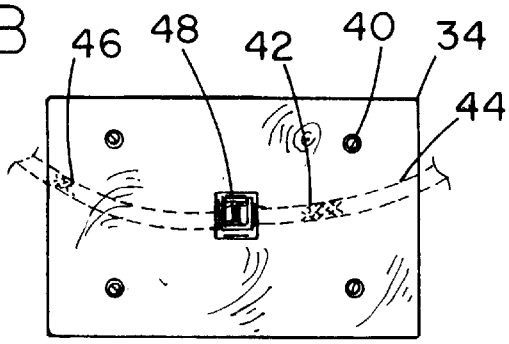
FIG. 3B

JOIST SAFETY SKID

BACKGROUND OF THE INVENTION

1. Field of the Invention

The present invention relates to portable platforms and more particularly pertains to a new joist safety skid for allowing a user to perform tasks on a plurality of joist of a ceiling.

2. Description of the Prior Art

The use of portable platforms is known in the prior art. More specifically, portable platforms heretofore devised and utilized are known to consist basically of familiar, expected and obvious structural configurations, notwithstanding the myriad of designs encompassed by the crowded prior art which have been developed for the fulfillment of countless objectives and requirements.

Known prior art portable platforms include U.S. Pat. No. 4,068,446; U.S. Pat. No. 5,022,670; U.S. Pat. No. Des. 318,575; U.S. Pat. No. 5,148,890; U.S. Pat. No. 4,121,690; and U.S. Pat. No. 4,730,424.

In these respects, the joist safety skid according to the present invention substantially departs from the conventional concepts and designs of the prior art, and in so doing provides an apparatus primarily developed for the purpose of allowing a user to perform tasks on a plurality of joist of a ceiling.

SUMMARY OF THE INVENTION

In view of the foregoing disadvantages inherent in the known types of portable platforms now present in the prior art, the present invention provides a new joist safety skid construction wherein the same can be utilized for allowing a user to perform tasks on a plurality of joist of a ceiling.

The general purpose of the present invention, which will be described subsequently in greater detail, is to provide a new joist safety skid apparatus and method which has many of the advantages of the portable platforms mentioned heretofore and many novel features that result in a new joist safety skid which is not anticipated, rendered obvious, suggested, or even implied by any of the prior art portable platforms, either alone or in any combination thereof.

To attain this, the present invention generally comprises a plurality of components each having an H-shaped configuration. Each component is defined by a pair of short spaced parallel hollow tubes with an interconnection member perpendicularly coupled between a central extent of each tube. As shown in FIG. 4, each of the components further has a pair of male ends formed on first ends of the tubes. Each male end is defined by a small cylinder with a diameter smaller than an outer surface of the tubes. With reference still to FIG. 4, it can be seen that each of the components further has a pair of female ends formed on second ends of the tubes. Each female end is defined by a cylindrical inset portion formed in an interior surface of the tubes. Such cylindrical inset portion has a diameter greater than the interior surface of the tubes. Each of the ends further has bores formed therein with an axis which is in perpendicular relationship with the interconnection member. For reasons that will become apparent hereinafter, the tubes further include equally spaced apertures formed therein along a length thereof and across those of the adjacent tube. Similar to the bores formed in the ends of the tubes, each of the apertures has an axis which is in perpendicular relationship with the interconnection member. As shown in FIG. 5, a compressible lock pin is coupled adjacent to at least one pair of the ends of the tubes of the components via a small cable. By this structure, the female ends of the components may be removably coupled with the male ends of other components and the components may be secured together by the removable insertion of each lock pin within the bores of the associated end. Next provided is a seat including a planar rigid plate and a cushion coupled to a top face thereof. As shown in FIG. 3B, the seat has four compressible mounting pins coupled to a bottom face thereof. During use, the mounting pins of the seat may be removably inserted within the apertures formed in the tubes of one of the components for allowing a user to sit thereon. Finally, a belt is included having a first strap having a first end coupled to the bottom face of the seat adjacent a first side edge thereof. Associated therewith is a second strap having a first end coupled to the bottom face of the seat adjacent a second side edge opposite the first side edge thereof. Second ends of the straps are equipped with a buckle for coupling the second ends thereby defining a closed loop. As such, the components may be disconnected and stacked such that the interconnection members are situated adjacent each other in order that the belt may be coupled about the interconnection members for storage purposes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new joist safety skid apparatus and method which has many of the advantages of the portable platforms mentioned heretofore and many novel features that result in a new joist safety skid which is not anticipated, rendered obvious, suggested, or even implied by any of the prior art portable platforms, either alone or in any combination thereof.

It is another object of the present invention to provide a new joist safety skid which may be easily and efficiently manufactured and marketed.

It is a further object of the present invention to provide a new joist safety skid which is of a durable and reliable construction.

An even further object of the present invention is to provide a new joist safety skid which is susceptible of a low cost of manufacture with regard to both materials and labor, and which accordingly is then susceptible of low prices of sale to the consuming public, thereby making such joist safety skid economically available to the buying public.

Still yet another object of the present invention is to provide a new joist safety skid which provides in the apparatuses and methods of the prior art some of the advantages thereof, while simultaneously overcoming some of the disadvantages normally associated therewith.

Still another object of the present invention is to provide a new joist safety skid for allowing a user to perform tasks on a plurality of joist of a ceiling.

Even still another object of the present invention is to provide a new joist safety skid that includes a plurality of components each having an H-shaped configuration. The components are adapted to be releasably coupled end-to-end. Further included is a seat removably coupled to at least one of the H-shaped components.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new joist safety skid according to the present invention.

FIG. 2 is a cross-sectional view taken along line 2—2 shown in FIG. 1 depicting the bores formed in the ends of the tubes.

FIG. 3A is a side view of the seat of the present invention.

FIG. 3B is a rear view of the seat of the present invention.

DESCRIPTION OF THE PREFERRED EMBODIMENT

Figure 4:
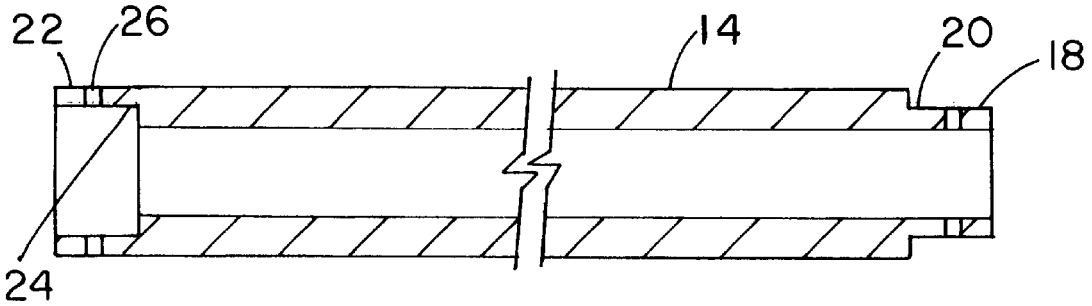
FIG. 4 is a cross-sectional view of one of the tubes of the present invention.

With reference now to the drawings, and in particular to FIGS. 1 through 6 thereof, a new joist safety skid embodying the principles and concepts of the present invention and generally designated by the reference numeral 10 will be described.

As shown in the Figures, a plurality of components 12 are provided each having an H-shaped configuration. Each component is defined by a pair of short spaced parallel hollow tubes 14 with a solid interconnection tube 16 perpendicularly coupled between a central extent of each tube 14. Each of the components preferably has a length of about 2 feet and a width of about 6 inches.

As shown in FIG. 4, each of the components further has a pair of male ends 18 formed on first ends of the tubes. Each male end is defined by a small cylinder 20 with a diameter smaller than an outer surface of the tubes. With reference still to FIG. 4, it can be seen that each of the components further has a pair of female ends 22 formed on second ends of the tubes. Each female end is defined by a cylindrical inset portion 24 formed in an interior surface of the tubes. Such cylindrical inset portion has a diameter greater than the interior surface of the tubes.

Figure 5:
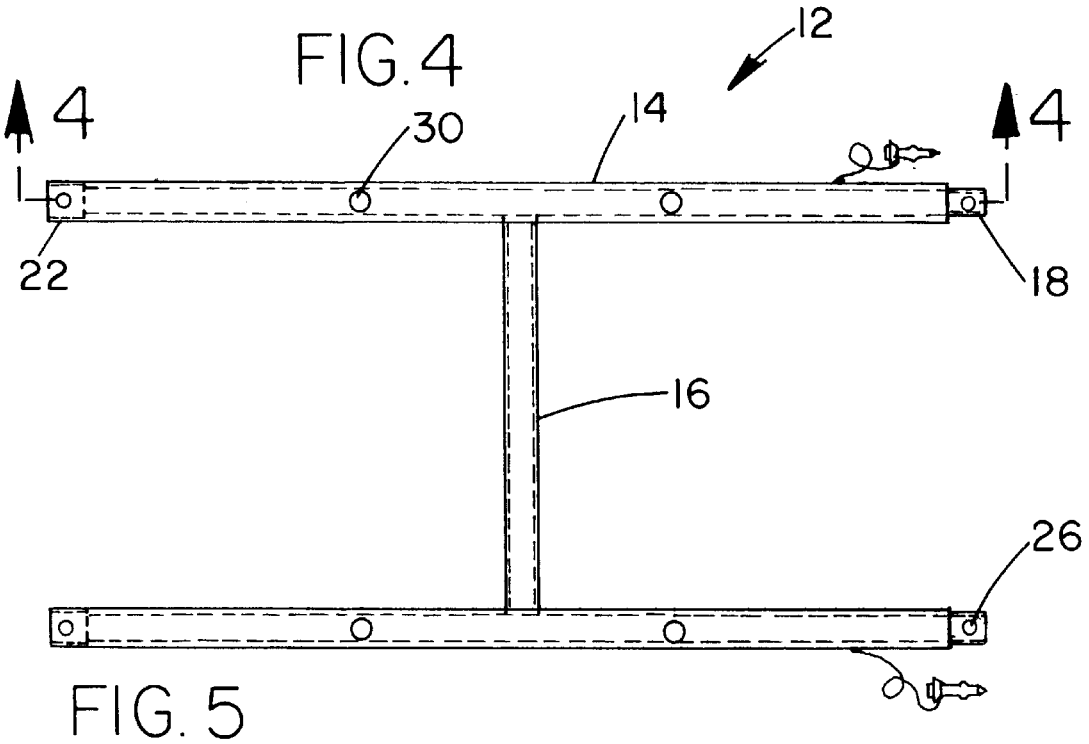
FIG. 5 is a top view of one of the H-shaped components of the present invention.
Figure 6:
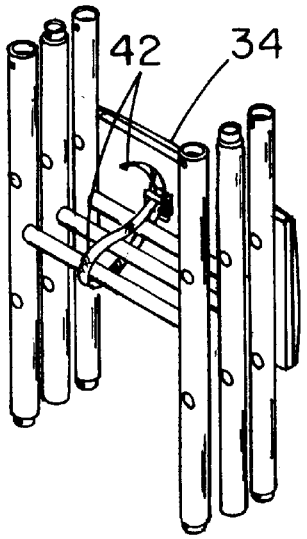
FIG. 6 is a perspective view of the H-shaped components of the present invention secured by the belt for storage.

Each of the ends further has bores 26 formed therein with an axis which is in perpendicular relationship with the interconnection member. For reasons that will become apparent hereinafter, the tubes further include equally spaced apertures 30 formed therein along a length thereof and across those of the adjacent tube. Such apertures are preferably each spaced from the interconnection member a predetermined equal distance, as shown in FIG. 5. Similar to the bores formed in the ends of the tubes, each of the apertures has an axis which is in perpendicular relationship with the interconnection member.

As shown in FIG. 5, a compressible lock pin 32 is coupled adjacent to at least one pair of the ends of the tubes of the components via a small cable. By this structure, the female ends of the components may be removably coupled with the male ends of other components and the components may be secured together by the removable insertion of each lock pin within the bores of the associated end. When secured in tandem, the components are specifically tailored to be laid upon a plurality of joists and are adapted to support a user thereon.

It should be noted that, in the alternative, the male ends, female ends, and locking pins may be excluded in favor of hinges coupled between each of the ends of the components. Such hinges are adapted to allow the components to reside in linear alignment in a first orientation and further pivot solely clockwise to allow the components to be stacked for storage purposes in a second orientation.

Next provided is a seat 34 including a planar rigid plate 36 and a cushion 38 coupled to a top face thereof. As shown in FIG. 3B, the seat has four compressible mounting pins 40 coupled to a bottom face thereof. During use, the mounting pins of the seat may be removably inserted within the apertures formed in the tubes of one of the components for allowing a user to sit thereon. In the alternative, multiple seats may be included to be mounted along the length of the tandemly connected components.

It should be noted that each of the compressible coupling and mounting pins includes a plastic member with a cylindrical central portion, a bulbous bottom end, and a top end with a lip integrally coupled thereto. Each pin is preferably split along a portion of the length thereof such that the bulbous end may be contracted when it is situated within one of the bores or apertures and is pulled with a sufficient amount of force.

Finally, a belt 42 is included having a first strap 44 having a first end coupled to the bottom face of the seat adjacent a first side edge thereof. Associated therewith is a second strap 46 having a first end coupled to the bottom face of the seat adjacent a second side edge opposite the first side edge thereof. Second ends of the straps are equipped with a buckle 48 for coupling the second ends to define a closed loop. As such, the components may be disconnected and stacked such that the interconnection members are situated adjacent each other in order that the belt may be coupled about the interconnection members for storage purposes. Note FIG. 6.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A joist safety skid adapted for use with a plurality of joists comprising, in combination:

a plurality of components each having an H-shaped configuration defined by a pair of short spaced parallel hollow tubes with an interconnection member perpendicularly coupled between a central extent of each tube such that the components each have a length of about 2 feet and a width of about 6 inches, each of the components further having a pair of male ends formed on first ends of the tubes, each male end defined by a small cylinder with a diameter smaller than an outer diameter of the tubes, each of the components further having a pair of female ends formed on second ends of the tubes, each female end defined by a cylindrical inset portion formed in an interior diameter of the tubes with a diameter greater than the interior diameter of the tubes such that the components are interconnected and are adapted to be laid across the joists, each of the ends further having bores formed therein with an axis which is in perpendicular relationship with the interconnection member, the tubes further including equally spaced apertures formed therein along a length thereof and across those of the adjacent tube, wherein each of the apertures has an axis which is in perpendicular relationship with the interconnection member and are each further spaced from the interconnection member a common predetermined distance;

a compressible lock pin coupled adjacent to each of the ends of the tubes of the components via a small cable, wherein the female ends of the components may be removably coupled with the male ends of other components and the components may be secured together by the removable insertion of each lock pin within the bores of the associated end;

a seat including a planar rigid plate and a cushion coupled to a top face thereof, the seat having four compressible mounting pins coupled to a bottom face thereof, wherein the mounting pins of the seat may be removably inserted within the apertures formed in the tubes of one of the components for allowing a user to sit thereon; and said compressible lock pins and said mounting pins each including a plastic member with a cylindrical central portion, a bulbous bottom end, and a top end with a lip integrally coupled thereto, each pin being split along a portion of a length thereof such that the bulbous end may be contracted when situated within one of the bores and apertures and is pulled with a sufficient amount of force;

a belt having a first strap having a first end coupled to the bottom face of the seat and a second strap having a first end coupled to the bottom face of the seat, second ends of the straps having a buckle for coupling the second ends thereby defining a closed loop, wherein the components may be disconnected and stacked such that the interconnection members are situated adjacent each other in order that the belt may be coupled about the interconnection members for storage purposes.

2. A joist safety skid comprising, in combination:

a plurality of joists;

a plurality of components each having an H-shaped configuration defined by a pair of short spaced parallel hollow tubes with an interconnection member perpendicularly coupled between a central extent of each tube such that the components each have a length of about 2 feet and a width of about 6 inches, each of the components further having a pair of male ends formed on first ends of the tubes, each male end defined by a small cylinder with a diameter smaller than an outer diameter of the tubes, each of the components further having a pair of female ends formed on second ends of the tubes, each female end defined by a cylindrical inset portion formed in an interior diameter of the tubes with a diameter greater than the interior diameter of the tubes such that the components are interconnected and are laid across the joists, each of the ends further having bores formed therein with an axis which is in perpendicular relationship with the interconnection member, the tubes further including equally spaced apertures formed therein along a length thereof and across those of the adjacent tube, wherein each of the apertures has an axis which is in perpendicular relationship with the interconnection member and are each further spaced from the interconnection member a common predetermined distance;

a compressible lock pin coupled adjacent to each of the ends of the tubes of the components via a small cable, wherein the female ends of the components may be removably coupled with the male ends of other components and the components may be secured together by the removable insertion of each lock pin within the bores of the associated end;

a seat including a planar rigid plate and a cushion coupled to a top face thereof, the seat having four compressible mounting pins coupled to a bottom face thereof, wherein the mounting pins of the seat may be removably inserted within the apertures formed in the tubes of one of the components for allowing a user to sit thereon; and said compressible lock pins and said mounting pins each including a plastic member with a cylindrical central portion, a bulbous bottom end, and a top end with a lip integrally coupled thereto, each pin being split along a portion of a length thereof such that the bulbous end may be contracted when situated within one of the bores and apertures and is pulled with a sufficient amount of force;

a belt having a first strap having a first end coupled to the bottom face of the seat adjacent a first side edge thereof and a second strap having a first end coupled to the bottom face of the seat adjacent a second side edge opposite the first side edge thereof, second ends of the straps having a buckle for coupling the second ends thereby defining a closed loop, wherein the components may be disconnected and stacked such that the interconnection members are situated adjacent each other in order that the belt may be coupled about the interconnection members for storage purposes.

* * * * *